US007041004B2

(12) United States Patent
Engdahl

(10) Patent No.: US 7,041,004 B2
(45) Date of Patent: May 9, 2006

(54) PUTTER WITH ROTATABLE SHAFT FOR CONVERTING FROM PRACTICE TO PLAY

(76) Inventor: Duane Charles John Engdahl, 15801 N. 37th Dr., Phoenix, AZ (US) 85053

( * ) Notice: Subject to any disclaimer, the term of this patent is extended or adjusted under 35 U.S.C. 154(b) by 0 days.

(21) Appl. No.: 10/920,596

(22) Filed: Aug. 16, 2004

(65) Prior Publication Data

US 2005/0020373 A1 Jan. 27, 2005

Related U.S. Application Data

(63) Continuation-in-part of application No. 10/351,495, filed on Jan. 23, 2003, now Pat. No. 6,776,727.

(51) Int. Cl.
*A63B 53/02* (2006.01)

(52) U.S. Cl. ..... 473/340; 473/342; 473/325; 473/328; 473/330; 473/295; 473/305; 473/313

(58) Field of Classification Search ..... 473/340, 473/342, 324, 325, 328, 330, 334–337, 295, 473/305, 306, 307, 313, 314; D21/736
See application file for complete search history.

(56) References Cited

U.S. PATENT DOCUMENTS

| | | | | | |
|---|---|---|---|---|---|
| 1,847,963 | A | * | 3/1932 | Hix | 273/118 R |
| 3,399,898 | A | * | 9/1968 | Burkland | 473/340 |
| 3,637,218 | A | * | 1/1972 | Carlino | 473/325 |
| 4,523,758 | A | * | 6/1985 | Guendling, Jr. | 473/293 |
| 4,776,594 | A | * | 10/1988 | Rango | 473/249 |
| D325,949 | S | * | 5/1992 | Harris, Jr. | D21/741 |
| D335,691 | S | * | 5/1993 | Barker et al. | D21/736 |
| 5,383,664 | A | * | 1/1995 | Epperson | 473/340 |
| 5,415,399 | A | * | 5/1995 | Kettelson | 473/239 |
| 5,580,051 | A | * | 12/1996 | Fisher | 473/248 |
| D381,384 | S | * | 7/1997 | Delio | D21/745 |
| 5,716,287 | A | * | 2/1998 | Levocz et al. | 473/248 |
| 5,863,257 | A | * | 1/1999 | Busnardo | 473/246 |
| D458,979 | S | * | 6/2002 | Hill et al. | D21/736 |
| 6,776,727 | B1 | * | 8/2004 | Engdahl | 473/340 |

* cited by examiner

*Primary Examiner*—Raleigh W. Chiu
(74) *Attorney, Agent, or Firm*—Etherton Law Group, LLC; Sandra L. Etherton; J. Damon Ashcraft

(57) ABSTRACT

The present invention is an improved putter that combines several features to provide a balanced putter, which assists a player in perfecting a putt stroke during practice and repeating it with the same club during play. The shaft is attached to the clubhead such that it can swivel from a practice configuration to a play configuration. The clubhead has tapered top and bottom surfaces such that the angle of the shaft relative to the sole of the putter is no more than 80 degrees. The clubhead has a playing surface on one face that is parabolic and can be flat in the extreme. The clubhead has a practice surface on the other face that is curved, preferably elliptical, to assist the golfer in learning the proper stroke. The putter conforms to the Rules of Golf so that the player does not have to change clubs between practice and play. The club may be used for either a right- or left-handed stroke.

22 Claims, 6 Drawing Sheets

PUTTER WITH ROTATABLE SHAFT FOR CONVERTING FROM PRACTICE TO PLAY

CROSS-REFERENCE TO RELATED APPLICATIONS

This application is a continuation-in-part of application Ser. No. 10/351,495 filed Jan. 23, 2003 now U.S. Pat. No. 6,776,727 and claims the benefit thereof.

FIELD OF INVENTION

This invention relates to putters that can be used for practice and play, with either a right or left-handed stroke. Specifically, this invention is a putter rotatable from a first position to strike a golf ball with a practice face of a clubhead to a second position to strike a golf ball with a play face of the clubhead.

BACKGROUND

Golf is governed by The Rules of Golf as approved by the United States Golf Association and the Royal and Ancient Golf Club of St. Andrews, Scotland, referred to herein as the USGA Rules. The most current rules are available from www.USGA.org. A typical game of golf is played on a course having 18 holes and a golfer may carry up to 14 clubs with him during play. An average golfer uses over 80 strokes to complete the game, and typically half of those stokes are putts. Therefore, the putter is by far the most important of the regulation 14 golf clubs in a golfer's bag, and improved putting will improve a player's score more than improvement in any other stroke.

Consequently, thousands of devices and methods have been devised to help a golfer improve his putting, ranging from the practical to the absurd. Most of these devices do not conform to the design of clubs specified by the USGA Rules, however, and therefore are used during practice only. The golfer must switch putters to play a round of golf, thus changing the primary tool with which he perfected his stroke. As a result, the putt stokes during play are seldom as good as during practice. It would be advantageous, then, to provide a dual-purpose putter that conforms to the Rules of Golf so that the golfer can use the same putter in practice as in play.

Under the USGA Rules, the putter shall have a shaft and a head, fixed to form one unit. When the golf club is in its normal position to address the ball, the shaft shall be aligned so that the projection of the straight part of the shaft onto the vertical plane through the toe and heel shall diverge from the vertical by at least 10 degrees. Further, the projection of the straight part of the shaft onto the vertical plane along the intended line of play shall not diverge from the vertical by more than 20 degrees. The USGA Rules further require that the clubhead meet specific criteria. For example, the distance from the heel to the toe of a putter shall be greater than the distance from the play face to the back. These rules limit the orientation of the shaft to the clubhead, and therefore the balance of the putter, a major factor in aligning the ball and in putting consistently.

The penalty for playing a game of golf with a putter that does not conform to the USGA Rules is disqualification from the game. However, with the many rules pertaining to the design of putters, it is difficult to design a club that provides quality training features for practicing and yet can be used for play. It is desirable to provide a single putter that can be converted from a practice putter to a play putter that conforms to USGA Rules.

Therefore, it is an object of this invention to provide a putter that enables the golfer to determine which strokes are the best during practice so that he may practice those strokes repeatedly and learn to stroke the ball consistently in play. It is another object of this invention to provide a single putter that can be used for both practice and play. It is another object to provide a single putter that can be converted from a practice putter to a play putter that conforms to the USGA Rules. It is an object of this invention to provide a putter in which the shaft always diverges at least 10 degrees from the sole of the clubhead, regardless which orientation the golfer holds the putter when addressing the ball.

SUMMARY OF THE INVENTION

The present invention is an improved putter that combines several features to provide a balanced putter, which assists a player in perfecting a putt stroke during practice and repeating it with the same club during play. The shaft is attached to the clubhead such that it can swivel from a practice configuration to a play configuration. The clubhead has tapered top and bottom surfaces such that the angle of the shaft relative to the sole of the putter is no more than 80 degrees. The clubhead has a playing surface on one face that is parabolic and can be flat in the extreme. The clubhead has a practice surface on the other face that is curved, preferably elliptical, to assist the golfer in learning the proper stroke. The putter conforms to the Rules of Golf so that the player does not have to change clubs between practice and play. The club may be used for either a right- or left-handed stroke.

BRIEF DESCRIPTION OF THE DRAWINGS

FIG. 1(*b*) is a perspective view of the play face of the clubhead, with the shaft in position for a right-handed golfer.

FIG. 2(*b*) is a bottom view of the clubhead.

FIG. 2(*c*) is a cross-section view of the clubhead 11 along line c—c of FIG. 2(*a*).

FIG. 2(*d*) is an end view of the clubhead; each end is symmetric to the other.

FIG. 5(*b*) illustrates the angle of the shaft to the sole of the putter for a right-handed stroke.

FIG. 5(*c*) illustrates the angle of the shaft to the sole of the putter for a left-handed stroke.

FIG. 8(*b*) is a plan view of the play face of the preferred embodiment, having a flat play insert.

FIG. 9(*b*) is a plan view of the play face of an alternate embodiment having a parabolic, concave play insert.

FIG. 9(*c*) is a side view of the alternate embodiment, showing a convex practice face and a concave play face.

FIG. 10(*b*) illustrates a golfer practicing a left-handed putt stroke with the practice face.

DETAILED DESCRIPTION OF THE INVENTION

Figure 1A:
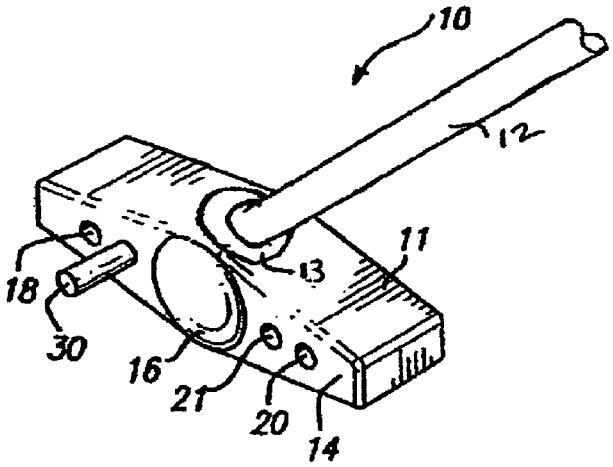
FIG. 1(*a*) is a perspective view of the practice face of the clubhead with the shaft in position for a right-handed golfer.
Figure 1B:
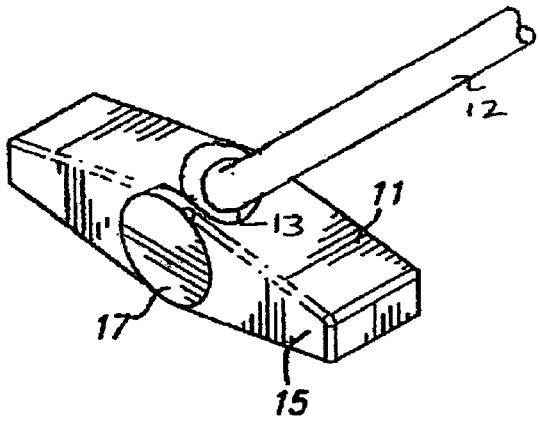

A clubhead 11 of an improved putter 10 is attached to a shaft 12 with a hosel 13. The present device may be used with shafts of any length. The clubhead 11 has two faces, a practice face 14 and a play face 15. Only the play face is used as a striking surface during play, thereby conforming with a USGA Rule that a clubhead have only one striking face. The shaft is attached to the clubhead in such a way that the clubhead can swivel from a practice position to a play position, keeping the shaft in the same position relative to the golfer. See FIG. 1*a* which shows the clubhead in the practice position for a right handed golfer and FIG. 1*b* which shows the clubhead after it has been swiveled into the play position.

Figure 2A:
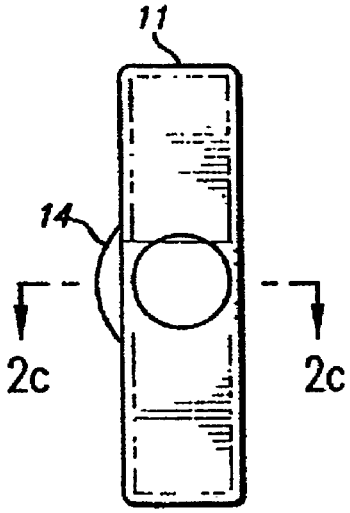
FIG. 2(*a*) is a top view of the clubhead.
Figure 2B:
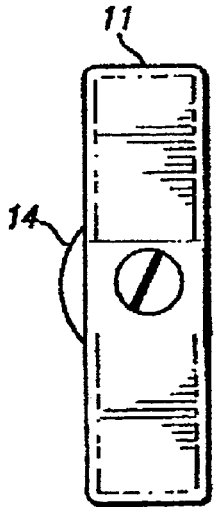
Figure 2C:
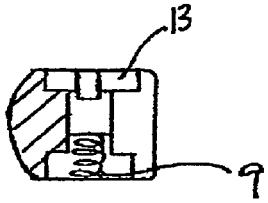
Figure 2D:
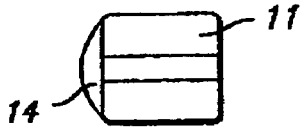
Figure 4:
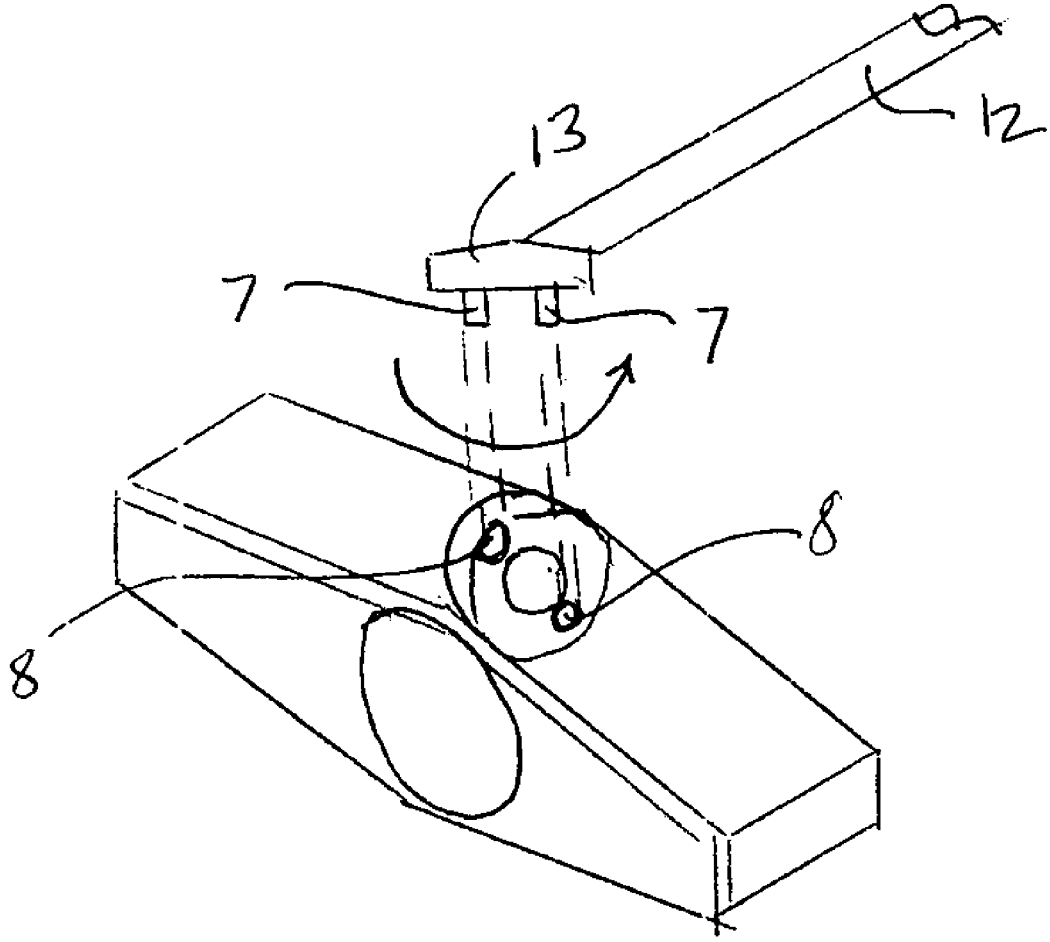
FIG. 4 illustrates an exploded view of the clubhead, illustrating the hosel and its alignment with the receiving holes.

In the preferred embodiment, the shaft is affixed to the hosel or integral with it. The hosel 13 is attached to a spring 9 that is biased to keep the hosel substantially flush with the top surface of the clubhead. See FIG. 2*c*. The clubhead is switched from a practice position to a play position by pulling the shaft away from the clubhead, thereby extending the spring 9. Once the hosel is free of its seated position in the clubhead, the clubhead is rotated 180 degrees relative to the shaft. The shaft is released, thereby allowing the hosel to be drawn back to the clubhead again as the spring 9 contracts. See FIG. 4. The hosel is guided to its seated position and the playface is now facing the ball.

In the preferred embodiment, the hosel has two pins 7 that extend toward the clubhead that rest inside two receiving holes 8. The hosel can be firmly seated in the clubhead in other ways, for example using a detente system having hemispherical projections and mated recesses.

The practice face 14 has a substantially circular insert, referred to as a practice insert 16. The practice insert 16 is convex relative to the practice face 14, as best illustrated in FIGS. 2*a*–*d*, and the practice face shape ranges from elliptical to spherical. The curved shape limits the number of points at which the practice face can strike a golf ball in order for the golf ball to move in a straight line perpendicular to the practice face, referred to as the line of putt. Hitting the center of the golf ball with the center of the practice face will cause the golf ball to move on the perpendicular line. However, if the golfer hits the golf ball with any part of the practice face other than the center of the practice insert, the golf ball will veer off the perpendicular line. The farther away from the center of the practice insert, the worse the veer angle will be.

Preferably the practice insert 16 is an ellipse. With an elliptically curved practice insert, the veer is relatively small at short radii from its center, thereby being somewhat forgiving to a less-than-perfect stroke. This approximates the amount of forgiveness of putts in play, because slight deviations for a perfect line of putt will not prevent the golf ball from falling in the hole. However, as the veer angle grows increasingly larger farther away from the center of the practice face, the "penalty" for a bad stroke increases as the stokes become increasingly off-center. A spherical practice insert may also be used; it provides a less forgiving center, but a more forgiving perimeter, as the veer angle changes relatively less than at the perimeter of an elliptical practice insert. The "penalty" for a bad stroke is constant regardless of how off-center the stroke is. It is likely that a better golfer will use the spherical practice insert to fine tune his putt stroke.

In addition to the curvature of the practice insert, the present invention includes alignment apertures for assisting the golfer in visualizing a straight line to the ball or other desired point. Each alignment aperture is made in the clubhead 11 to receive a lightweight post 30 that extends substantially perpendicularly from the practice face 14. A conventional drinking straw is suitable for the post, as is it extremely lightweight and most convenient to obtain at a golf course. Preferably, therefore, the diameter of each aperture is made to enable a drinking straw to be inserted and held in place snugly simply by friction. A post can be inserted in any one or more of the alignment apertures, in whichever placement the golfer finds it assists his alignment the best. In the preferred embodiment, the practice face 14 has two alignment apertures, 18 and 20, however more are acceptable, as indicated by aperture 21 and the aperture into which post 30 is inserted.

The play face 15 also has a substantially circular insert, referred to as a play insert 17. The play insert 17 is inwardly parabolic relative to the play face 15, ranging from flat to concave. A flat striking face is required under USGA Rules, so a flat play insert should be used when playing a round of golf.

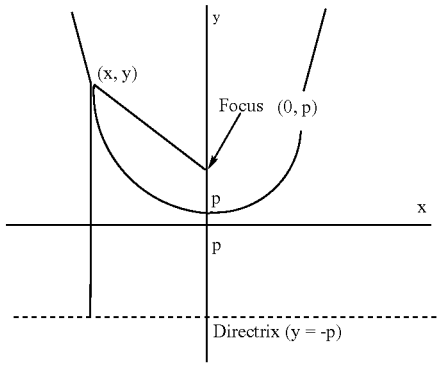

A parabolic-shaped play insert is self-correcting to some degree, because the curve of the insert will urge the golf ball to the center of the parabola before redirecting the ball away from the play face. A parabola is the set of all points in a plane equidistant from a fixed point (called the focus) and a fixed line (called the directrix). The formula for a parabola is generally:

$$y = \frac{x^2}{4p}$$

Thus, when p is large, the curvature of the play insert is great and the ball is strongly urged to the center of the parabola. As the parabola flattens out, that is, as p becomes small, the play insert provides less assistance in getting the ball to travel on the putt line perpendicular to the play face. When the parabola is flat, that is, when y is constant, the striking face is flat, and the putter provides no self-correcting assistance to the golfer. Preferably, the play insert 17 is flat so that the putter conforms to USGA Rules.

Figure 3:
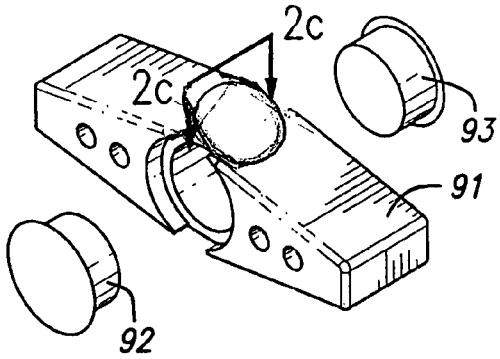
FIG. 3 is an exploded, perspective view of the clubhead with a curved practice face and a flat play face.

FIG. 3 illustrates a preferred embodiment of the clubhead having a core 91, curved practice insert 92 and flat play insert 93. The top and the bottom of the clubhead are substantially v-shaped with flattened apexes, the tapered sides serving to position the shaft at an appropriate angle to the ground during practice and play, as described in more detail below. The clubhead is operable with sharp edges where the various faces meet, but preferably the edges are rounded. Preferably the clubhead 11 is manufactured as a core having apertures into which the hosel and shaft assembly, practice insert and play insert are inserted to form an integral unit. The inserts must be firmly fixed so that there is little likelihood of them working loose during a round of golf. The inserts may be integral with the core 91 of the clubhead 11, or may be separate pieces that are attached to the core or face of the clubhead, with adhesive or friction fit. Preferably the practice inserts and play inserts are changeable to accommodate the needs of the golfer and preferably the insets are threaded to mate with a threaded aperture in the core 91. They also may be attached in other ways, such as friction fit.

The core is made of any durable material, and preferably metal such as aluminum, brass or steel. The practice insert is also made of a durable material, but preferably a hard composite material such as a polymer that provides for a satisfying "thunk," such as Surlyn® thermoplastic resin sold by the E.I. DuPont De Nemours and Company, which was the first and most durable cover material that revolutionized the construction of the golf ball when it was introduced in the 1980s. The play insert is made of durable materials, metal or composite, and preferably the same material as the practice insert so that the feel of the practice stroke is the same as the stroke during play.

Figure 5A:
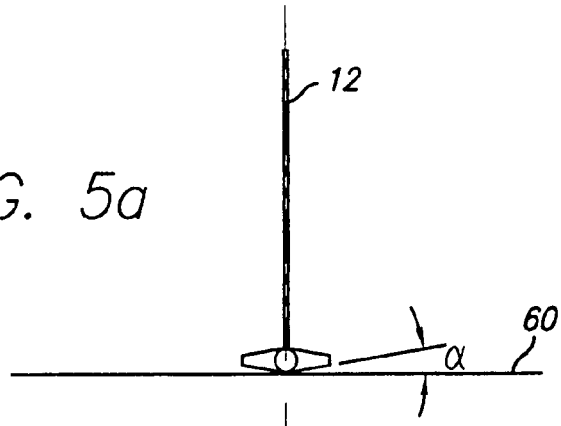
FIG. 5(*a*) illustrates the angle of the shaft to the sole of the putter when the putter is standing upright.
Figure 5B:
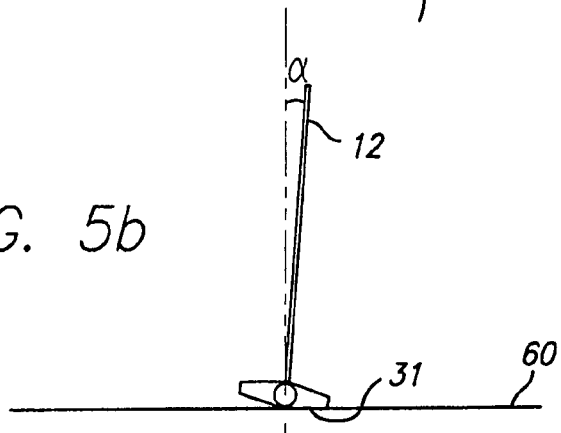
Figure 5C:
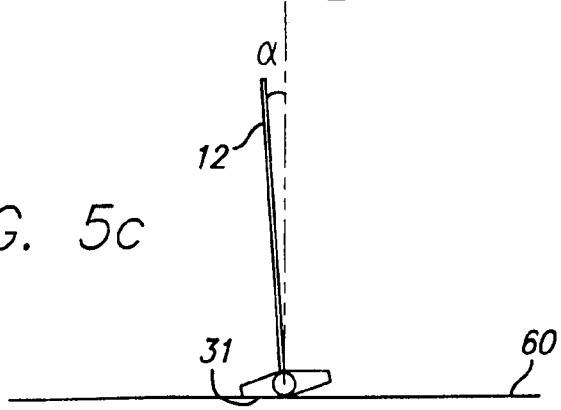

For aligning the ball and for putting consistently, it is advantageous to have a puffer that is balanced in as many dimensions as possible. One USGA Rule requires that the projection of the straight part of the shaft onto the vertical plane through the toe and heel shall diverge from the vertical by at least 10 degrees. In other words, the angle between the shaft and the sole of the club must be less than 80 degrees. To achieve both a balanced clubhead and this angle, the bottom of the clubhead is tapered in a V, upward from the midpoint of the bottom to the toe and heel. When putting, one side of the bottom of the club will be resting on or parallel to the playing surface. This portion of the bottom becomes the sole of the club. Due to the taper and the shaft's orientation to the clubhead, the shaft is then atways tilted at least 10 degrees from vertical. The clubhead can be rotated to accommodate for either a right-handed or left-handed golfer. FIG. 5 illustrates the resultant effect, where $\alpha$ is the angle between the vertical and the shaft. In FIG. 5(*a*), the putter is shown in its upright position with the shaft 12 perpendicular to the playing surface 60. FIG. 5(*b*) illustrates the putter in the position as a right-handed golfer addresses the ball. Note that $\alpha$ is at least 10 degrees, making the shaft 12 at least 10 degrees off vertical; in other words, the angle between the shaft and the sole 31 of the club is less than 80 degrees. FIG. 5(*c*) illustrates the putter in the position as a left-handed golfer addresses the ball. Note again that the shaft 12 is at least 10 degrees off vertical, so that the angle between the shaft 12 and the sole 32 is less than 80 degrees. Since the clubhead is tapered by at least 10 degrees, the shaft will always diverge at least 10 degrees from the plane through the toe and heel, regardless of which orientation the golfer uses to address the ball. To maintain symmetry and weight balance in the clubhead, the top should be similarly tapered. That is, the top of the clubhead is tapered in a V, downward from the midpoint of the top to the toe and heel.

Figure 6:
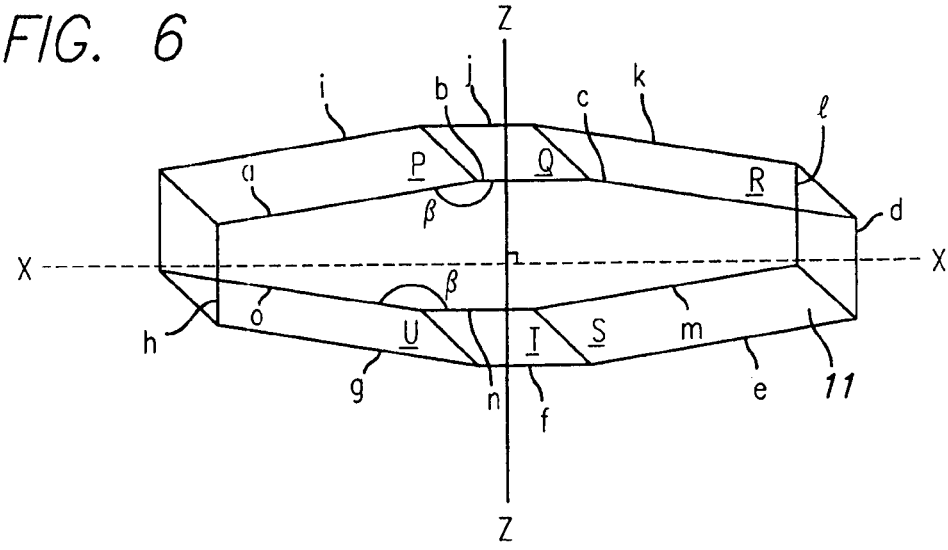
FIG. 6 is a perspective schematic view of the clubhead, indicating the sides and faces of the preferred embodiment.

The clubhead 11 is a polyhedron. Preferably the perimeter of the practice face 16 and play face 17 are octagons as shown in FIG. 6. The perimeter of the practice face has sides a, b, d, c, e, f, g and h. The perimeter of the play face has sides i, j, k, l, m, n, o and p. The practice face and play face are substantially parallel to each other, and connected to each other with a top and a bottom. The top of the polyhedron has three faces, P, Q and R that are attached to sides of the practice face a, b, c and the play face i, j, and k, respectively. The bottom has three faces, S, T and U that are attached to sides of the practice face e, f, g and play face m, n and o, respectively. The ends of the clubhead 11 are parallel to each other and perpendicular to face Q and face T of the bottom. The taper of the clubhead is the effect of the relationship of the sides to the top and bottom. In FIG. 6, the taper is therefore indicated by angle $\beta$. The angles between sides a and b, b and c, d and e, e and f, are equal and no more than 170 degrees, and the angles between sides i and j, j and k, m and n, n and o, are equal and no more than 170 degrees.

Figure 7:
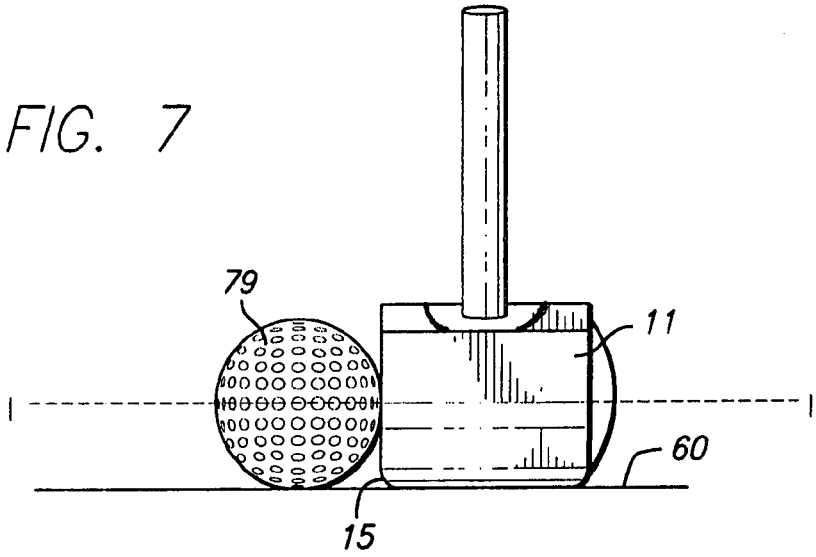
FIG. 7 illustrates the center of the clubhead aligned with the center of the golf ball at the instant the clubhead strikes the golf ball during a putt stroke.

To best control and eliminate spin on the golf ball, it is desirable to be able to strike the ball along the horizontal plane bisecting the center of the ball. FIG. 7 illustrates the centerline l—l of the play face 15 aligned with the center of a golf ball 79 upon impact with the golf ball. Consistent with good clubhead balance, preferably the practice and play faces are centered along the horizontal centerline of the clubhead 11. For good visual alignment, the practice and play faces are preferably about the same size as a golf ball. Preferably, therefore, the practice and play faces are centered on the clubhead so that the center of the practice and play faces meet the centerline of the ball when it is struck. The actual dimensions of the clubhead can be customized to take into account various factors including the player's stroke, the lay of the ball on the putting surface, and the length of the nap of the grass.

Figure 8A:
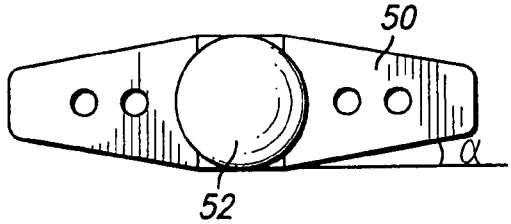
FIG. 8(*a*) is a plan view of the practice face of the preferred embodiment, having a convex practice insert.
Figure 8B:
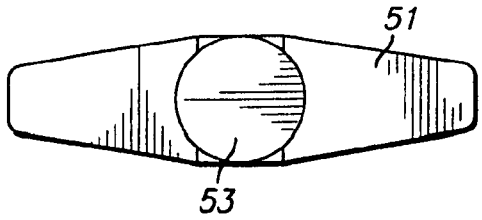
Figure 9A:
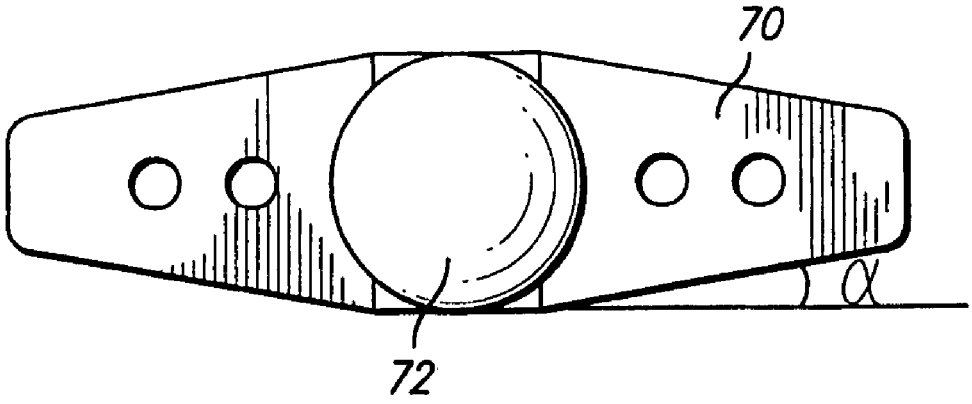
FIG. 9(*a*) is a plan view of the practice face of an alternate embodiment, having a convex practice insert.
Figure 9B:
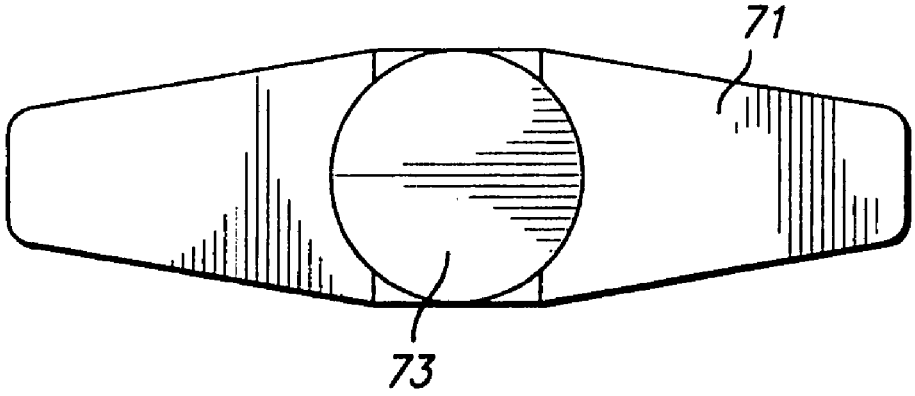
Figure 9C:
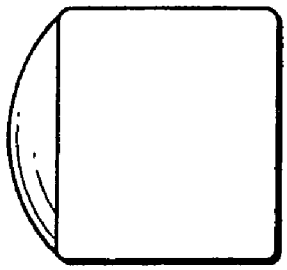

Many combinations of the shapes of the clubhead, play and practice faces are possible while still achieving the objective of this invention, as illustrated in FIGS. 8 and 9. FIG. 8 illustrates the preferred embodiment, wherein the practice face 50 (FIG. 8(*a*)) and play face 51 (FIG. 8(*b*)) are octagons and the taper angle $\alpha$ is about 10 degrees. The practice insert 52 is outwardly convex in an elliptical curve. The play insert 53 is flat. FIG. 9 illustrates an alternate embodiment, wherein the practice face 70 (FIG. 9(*a*)) and play face 71 (FIG. 9(*b*)) are octagons, but the taper angle $\alpha$ has been increased to about 20 degrees. The practice insert 72 is outwardly convex in a spherical curve and the play insert 73 is convex in a parabolic curve. FIG. 9(*c*) is a side view illustrating a convex practice face and a concave play face.

Figure 10A:
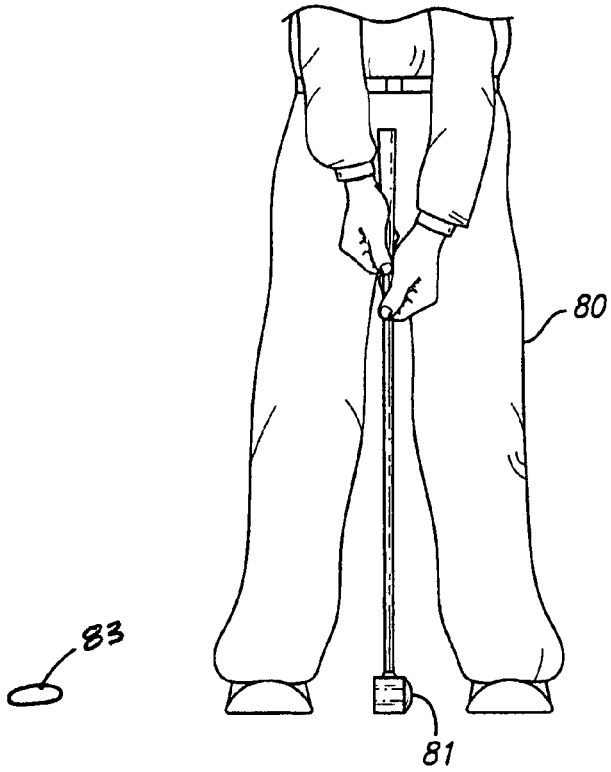
FIG. 10(*a*) illustrates a golfer playing a left-handed putt stroke with the play face.
Figure 10B:
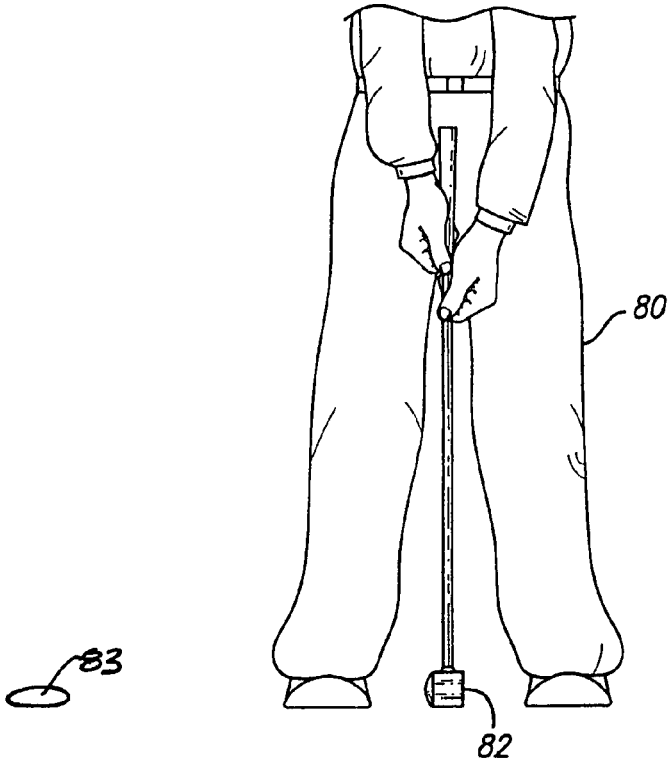

FIG. 10(*a*) illustrates a golfer 80 practicing a left-handed putt stroke into hole 83. The golfer uses the practice face 81 to hit the ball and improve his aim. By rotating the putter 180 degrees in his hands, the golfer can use the same putter and the same stance to putt in play. FIG. 10(*b*) illustrates the same golfer putting in play, using the play face 82 as the striking face.

While there has been illustrated and described what is at present considered to be the preferred embodiment of the present invention, it will be understood by those skilled in the art that various changes and modifications may be made and equivalents may be substituted for elements thereof without departing from the true scope of the invention.

Therefore, it is intended that this invention not be limited to the particular embodiment disclosed, but that the invention will include all embodiments falling within the scope of the appended claims.

I claim:

1. A putter comprising:

a) a shaft having a length and a diameter; and b) a clubhead attached to the shaft wherein the clubhead:

i) further comprises a practice face and a play face;

ii) can be swiveled about the shaft in a first plane that is about parallel to a second plane defined by the cross-section of the shaft taken along its diameter; and iii) is swiveled about the shaft in the first plane to a first position to strike the golf ball with a practice face of the clubhead and a second position to strike the golf ball with a play face of the clubhead.

2. The putter according to claim 1 further comprising:

a) a hosel attached to the shaft, the hosel having projections that fit within mated recesses in the clubhead; and b) a spring attached to the hosel biased in such a way to keep the hosel in the ciubhead;

such that the shaft can be pulled away from the clubbead to allow the clubhead to be swiveled about the shaft.

3. The putter of claim 1 wherein:

a) the clubhead comprises:

i. a play face having a polygonal perimeter;

ii. a practice face having a polygonal perimeter, the practice face substantially parallel to the play face;

b) a substantially v-shaped top and a substantially v-shaped bottom, each connected to the play face and the practice face.

4. The putter according to claim 3 wherein the bottom of the club head makes an angle of no more than 80 degrees with a line extending along the length of the shaft.

5. The putter according to claim 3 further comprising at least one alignment aperture in the practice face.

6. The putter according to claim 3 wherein the play face is substantially planar.

7. The putter according to claim 3 further comprising a circular play insert in the center of the play face.

8. The putter according to claim 7 wherein the play insert is parabolic.

9. The putter according to claim 7 wherein the play insert is made of a material different than that of the clubhead.

10. The putter according to claim 7 wherein the play insert is interchangeable with another play insert.

11. The putter according to claim 7 wherein the play insert is matedly threaded to an aperture in the clubhead.

12. The putter according to claim 3 wherein the polygon is an octagon.

13. The putter according to claim 3 wherein the shaft extends substantially to the bottom of the clubhead.

14. The putter according to claim 1 wherein the practice face is convex near its center.

15. The putter according to claim 1 further comprising a circular practice insert on the practice face, the practice insert being convex.

16. The putter according to claim 15 wherein the practice insert is made of a material different than that of the clubhead.

17. The putter according to claim 15 wherein the practice insert is interchangeable with another practice insert.

18. The putter according to claim 15 wherein the practice insert is matedly threaded to an aperture in the clubhead.

19. A putter comprising:

a) a shaft attached to a clubhead such that the clubhead can be swiveled about the shaft from a first position to strike a golf ball with a practice face of the clubhead to a second position to strike a golf ball with a play face of the clubhead;

b) wherein the clubhead is substantially solid and substantially symmetric and further comprises ten faces comprising:

i. a first face having sides a, b, c, d, e, f, g and h wherein the angles between sides a and b, b and c, e and f, f and g, are equal and no more than 170 degrees;

ii. a second face substantially parallel to the first face, the second face having sides i, j, k, l, m, n, o and p, wherein the angles between sides i and j, j and k, m and n, n and o, are equal and no more than 170 degrees;

iii. a tap connected to the first face and the second face, the top comprising a third face, a fourth face and a fifth face, wherein:

(1) the third face is connected to sides a and i;

(2) the fourth face is connected to sides b and j;

(3) the fifth face is connected to sides c and k;

iv. a bottom connected to the first face and the second face, the bottom comprising a sixth face, a seventh face and an eighth face, wherein:

(1) the sixth face is connected to sides e and m;

(2) the seventh face is connected to sides f and n;

(3) the eighth face is connected to sides g and o;

v. a ninth face connecting the top and bottom, the ninth face substantially perpendicular to the fourth and seventh faces;

vi. a tenth face connecting the top and bottom, the tenth face substantially perpendicular to the fourth and seventh faces; and c) a planar circular play insert attached to and in the same plane as the first face; and d) a convex circular practice insert attached to the second face.

20. The putter according to claim 19 wherein the play insert and the practice insert are made of a material different than that of the clubhead.

21. The putter according to claim 19 wherein the clubhead is metal and the play insert and the practice insert are a composite material.

22. The putter according to claim 19 wherein the practice and play inserts are matedly threaded to an aperture in the clubhead.

* * * * *